US010525567B2

(12) United States Patent
Chou et al.

(10) Patent No.: US 10,525,567 B2
(45) Date of Patent: Jan. 7, 2020

(54) CHEMICAL-MECHANICAL POLISHING ABRASIVE PAD CONDITIONER AND METHOD FOR MANUFACTURING SAME

(71) Applicant: Kinik Company Ltd., Taipei (TW)

(72) Inventors: Jui-Lin Chou, New Taipei (TW); Chin-Chung Chou, New Taipei (TW); Chung-Yi Cheng, New Taipei (TW); Hsin-Chun Wang, New Taipei (TW); Yu-Chau Hung, New Taipei (TW)

(73) Assignee: KINIK COMPANY LTD., Taipei (TW)

( * ) Notice: Subject to any disclaimer, the term of this patent is extended or adjusted under 35 U.S.C. 154(b) by 202 days.

(21) Appl. No.: 15/883,656

(22) Filed: Jan. 30, 2018

(65) Prior Publication Data

US 2018/0326553 A1 Nov. 15, 2018

(30) Foreign Application Priority Data

May 12, 2017 (TW) ..... 106115709 A

(51) Int. Cl.

| | |
|---|---|
| ***B24B 53/017*** | (2012.01) |
| ***B24B 53/00*** | (2006.01) |
| ***B24D 18/00*** | (2006.01) |
| ***C08K 3/22*** | (2006.01) |
| ***C08K 3/02*** | (2006.01) |
| ***C30B 29/36*** | (2006.01) |

(52) U.S. Cl.
CPC ..... *B24B 53/017* (2013.01)

(58) Field of Classification Search
CPC .... B24B 53/017; B24D 18/0009; C08K 3/22; C08K 2003/2227; C08K 2003/2255; C08K 2003/026; C08K 3/02
See application file for complete search history.

(56) References Cited

U.S. PATENT DOCUMENTS

| | | | | |
|---|---|---|---|---|
| 6,213,856 | B1 * | 4/2001 | Cho | B24B 53/017 451/443 |
| 2012/0171935 | A1 * | 7/2012 | Ruland | B24B 53/017 451/56 |
| 2015/0283671 | A1 * | 10/2015 | Chou | B24B 53/017 451/443 |
| 2016/0236320 | A1 * | 8/2016 | Chou | B24B 53/017 |
| 2016/0346901 | A1 * | 12/2016 | Chou | B24B 53/017 |
| 2018/0104792 | A1 * | 4/2018 | Hong | B24B 37/005 |

* cited by examiner

*Primary Examiner* — Dung Van Nguyen
(74) *Attorney, Agent, or Firm* — Muncy, Geissler, Olds & Lowe, P.C.

(57) ABSTRACT

The present invention provides a CMP abrasive pad conditioner, comprising a bottom substrate; an intermediate layer located on the bottom substrate, the intermediate layer including a hollow portion and an annular portion surrounding the hollow portion, the annular portion being provided with a plurality of bumps; and a diamond film located on the intermediate layer, and forming a plurality of abrasive projections corresponding to the bumps of the intermediate layer; in this case, a top surface of the abrasive projections is formed with a patterned configuration and the top surface is provided with a center line average roughness (Ra) between 2 and 20.

16 Claims, 16 Drawing Sheets

CHEMICAL-MECHANICAL POLISHING ABRASIVE PAD CONDITIONER AND METHOD FOR MANUFACTURING SAME

FIELD OF THE INVENTION

The present invention is related to a chemical-mechanical polishing (CMP) abrasive pad conditioner, particularly to a CMP abrasive pad conditioner having both good machining capability and removing capability as well as a method for manufacturing same.

BACKGROUND OF THE INVENTION

In the semiconductor wafer fabrication process, it is common to use a chemical-mechanical polishing (CMP) process for achieving the object of planarization of the surface of wafer, in which a polishing pad fixed to a rotary table is used to contact with and polish the wafer. Fragments generated by polishing, and polishing slurry may be accumulated in voids of the polishing pad, and the polishing pad is then consumed so as to reduce the polishing effect over a long period. Therefore, it is common to use a conditioner for the removal of the fragments and polishing shiny remained in the polishing pad.

The conventional CMP abrasive pad conditioner is roughly classified into two categories: one is a diamond particle used as polishing material, and the other is a diamond film, deposited by chemical vapor deposition (CVD), used as polishing material.

In conventional technology, in respect of the CMP abrasive pad conditioner utilizing the diamond film deposited by CVD as polishing material, a CMP pad conditioner, provided by Taiwan Patent Publication No. 200948533, for example, is allowed to apply a CVD diamond coating onto a substrate consisting of ceramic material and an preferably unreacted carbide-forming material, while the conditioner thereof is provided with predictable or unpredictable raised surface features for assisting in the usefulness of the conditioner. The above raised surface features include concentric circles, broken or staggered concentric circles, spirals, broken spirals, rectangles, broken rectangles and so on.

In addition, the applicant provided, in Taiwan Patent Application No. 105124293 proposed previously, a CMP abrasive pad conditioner comprising a bottom substrate, an intermediate substrate and a polishing layer. The intermediate substrate is located on the bottom substrate. The intermediate substrate includes a hollow portion, an annular portion surrounding the hollow portion, and at least one projecting ring projecting out of the annular portion away from the bottom substrate. The projecting ring includes a plurality of bumps arranged to be spaced apart from each other along an annulus region. The bumps are extended in a radial direction of the intermediate substrate. Moreover, a diamond layer is located on the intermediate substrate, for conforming to the bumps, so as to form a plurality of the abrasive projections. The abrasive projections may be provided with either a flat top surface, or a rough top surface.

Furthermore, Taiwan Patent Publication No. 201249595, for example, provided a chemical mechanical planarization polishing pad conditioner, including a substrate comprising a first subset of protrusions and a second subset of protrusions, the first subset of protrusions comprising a first average height, and the second subset of protrusions comprising a second average height different from the first average height. Moreover, the top of the first subset of protrusions and that of the second subset of protrusions are both provided with a layer of polycrystalline diamond. In the specification of this application, it is mentioned that the distal surface of one or more protrusions of the first subset of protrusions may be provided with an irregular or rough surface, while the distal surface of each protrusion of the second subset of protrusions may be provided with irregular or rough surface. In another embodiment, however, the top of one or more projections of the first subset of protrusions may be provided with a flat surface, while the top of each protrusion of the second subset of protrusions may be provided with a flat surface.

The aforementioned CMP abrasive pad conditioner, using a CVD diamond film as polishing material, may be further combined with polishing particles. For instance, the applicant just disclosed, in Taiwan Patent Publication No. 201630689 proposed previously, a CMP abrasive pad conditioner comprising a base. The surface of the base is divided into a central surface and a peripheral surface concentrically. The central surface is depressed to be a depressed portion. The peripheral surface surrounding the central surface is depressed to form a plurality of mounting holes. Moreover, a plurality of sliders are provided on the peripheral surface and spread between the mounting holes. Each slider is provided with a conditioning face. In addition, the CMP conditioner is further provided with a plurality of conditioning posts, each conditioning post being correspondingly located in the mounting hole. The conditioning post comprises a post body and an abrasive material mounted on the top surface of the post body.

In the above prior art, for example, Taiwan Patent Publication No. 200948533 only mentioned the raised surface features formed on the substrate. Moreover, although Taiwan Patent Application No. 105124293, Taiwan Patent Publication No. 201249595 and No. 201630689 disclosed that the abrasive projection may be provided with a rough top surface, the rough top surface is not further defined or described yet. Only in the specification of Taiwan Patent Publication No. 201249595, it is roughly mentioned that roughness or the irregular surface may be at least partly attributable to roughness of porous graphite substrate of converted silicon carbide. Furthermore, the rough top surface is only one aspect of embodiment. In another embodiment, a flat top surface is also allowed. Obviously, the type of the top surface of the abrasive projection is not the key point on which the aforementioned prior art focused.

Therefore, even though the effects of consistent polishing or cutting speed, enhanced removing capability and etc., are obtained by providing a plurality of nonplanar bumps and arranging the bumps in a specific form via improvement on the top surface of the conventional CMP conditioner in the aforementioned prior art, the fragments remained in pores of the abrasive pad are still incapable of being removed effectively in the practical application of machining and the service life of the (MP conditioner is impacted.

SUMMARY OF THE INVENTION

It is the main object of the present invention to eliminate the drawback of shortened service life of the chemical-mechanical polishing (CMP) conditioner due to incapability of removing impurities and chips effectively of the conventional CMP conditioner using a chemical vapor deposition (CVD) diamond film.

For achieving the above object, it is found that, in the present invention, when a top surface (e.g., working face) of a CMP abrasive pad conditioner is machined to be provided with a patterned configuration and a specific center line average roughness (Ra), uniformity of the CMP abrasive pad conditioner is better, and the better effect of removing fragments is also exhibited.

More specifically, a CMP abrasive pad conditioner provided by the present invention comprises: a bottom substrate; an intermediate layer located on the bottom substrate, the intermediate layer including a hollow portion and an annular portion surrounding the hollow portion, the annular portion being provided with a plurality of bumps; and a diamond film located on the intermediate layer, and forming a plurality of abrasive projections corresponding to the plurality of bumps of the intermediate layer; in this case, a top surface of each of the plurality of abrasive projections is formed with a patterned configuration and the top surface is provided with a center line average roughness (Ra) between 2 and 20.

In one embodiment of the present invention, the patterned configuration includes a plurality of solid figures arranged regularly or irregularly.

In one embodiment of the present invention, each of the plurality of solid figures is selected from the group consisting of triangular pyramid, quadrangular pyramid, pentagonal pyramid, hexagonal pyramid, heptagonal pyramid, octagonal pyramid, triangular prism, quadrangular prism, pentagonal prism, hexagonal prism, heptagonal prism, octagonal prism, circular cone, circular cylinder, elliptic cone, elliptic circle cylinder and the combination thereof.

In one embodiment of the present invention, there is a first interval between the center point of one of the plurality of solid figures and the center point of adjacent solid figure, the first interval being longer than a width of the solid figure, and the first interval being 0.5 to 8.3 times as long as the width of the solid figure.

In one embodiment of the present invention, the first interval is in a range of 50 μm to 250 μm.

In one embodiment of the present invention, each of the plurality of solid figures is provided with a width between 30 μm and 100 μm.

In one embodiment of the present invention, a number of the plurality of solid figures included on each of the plurality of abrasive projection per square millimeter ($mm^2$) is in a range of 10 to 250.

In one embodiment of the present invention, the plurality of solid figures are arranged to form a plurality of solid figure aggregation portions on each of the plurality of abrasive projections.

In one embodiment of the present invention, at least one flat region is provided between one of the plurality of solid figure aggregation portions and one adjacent solid figure aggregation portions, without the abrasive projection being included in the flat region.

In one embodiment of the present invention, the intermediate layer is made of conducting silicon carbide or non-conducting silicon carbide.

In one embodiment of the present invention, each of the plurality of abrasive projections is presented as an arc with respect to a radial direction of the intermediate layer.

In one embodiment of the present invention, the plurality of bumps are arranged on the annular portion to form projecting rings, and the plurality of bumps of adjacent projecting rings are offset with respect to each other.

In one embodiment of the present invention, the plurality of bumps of the annular portion are formed through energy machining, electric discharge machining or die casting.

In one embodiment of the present invention, a method for manufacturing CMP abrasive pad conditioner comprising: providing a bottom substrate; locating an intermediate layer, the intermediate layer including a hollow portion and an annular portion surrounding the hollow portion, the annular portion being formed thereon with a plurality of bumps; forming a diamond film on the intermediate layer, and forming a plurality of abrasive projections by conforming the diamond film to the plurality of bumps of the intermediate layer, a top surface of each of the plurality of abrasive projections being formed with a patterned configuration and provided with a center line average roughness (Ra) between 2 and 20; and fixing the intermediate layer at one side thereof to the bottom substrate.

In one embodiment of the present invention, the intermediate layer is fixed to the bottom substrate via a bonding layer.

In one embodiment of the present invention, the bumps of the annular portion are formed through energy machining, electric discharge machining or die casting.

Thus, the CMP abrasive pad conditioner of the present invention is provided on the top surface thereof with a patterned configuration, so as to increase a center line average roughness (Ra) of the top surface. In comparison with conventional technology, therefore, uniformity of the CMP abrasive pad conditioner of the present invention is enhanced. Furthermore, when the CMP abrasive pad conditioner with good uniformity is used for conditioning, even figments remained in pores may be also removed successfully. Thereby, removing capability may be enhanced. The above merits are summarized that the service life of the CMP conditioner of the present invention will be extended.

DETAILED DESCRIPTION OF THE PREFERRED EMBODIMENTS

The detailed description and technical content of the present invention will now be described in accompany with drawings as follows.

First Embodiment

Figure 1:
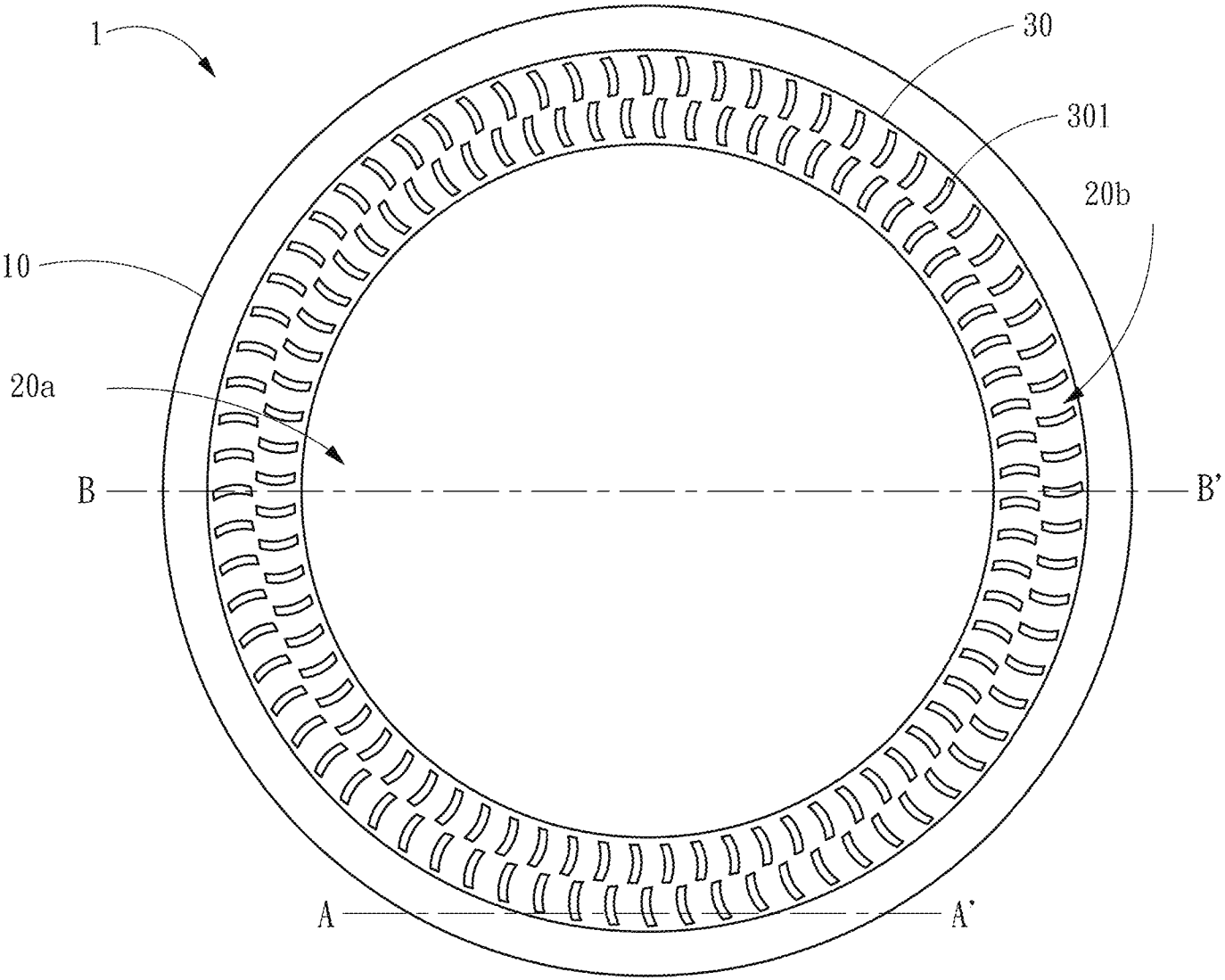
FIG. 1 is a top view of a CMP abrasive pad conditioner of a first embodiment of the present invention.
Figure 2A:
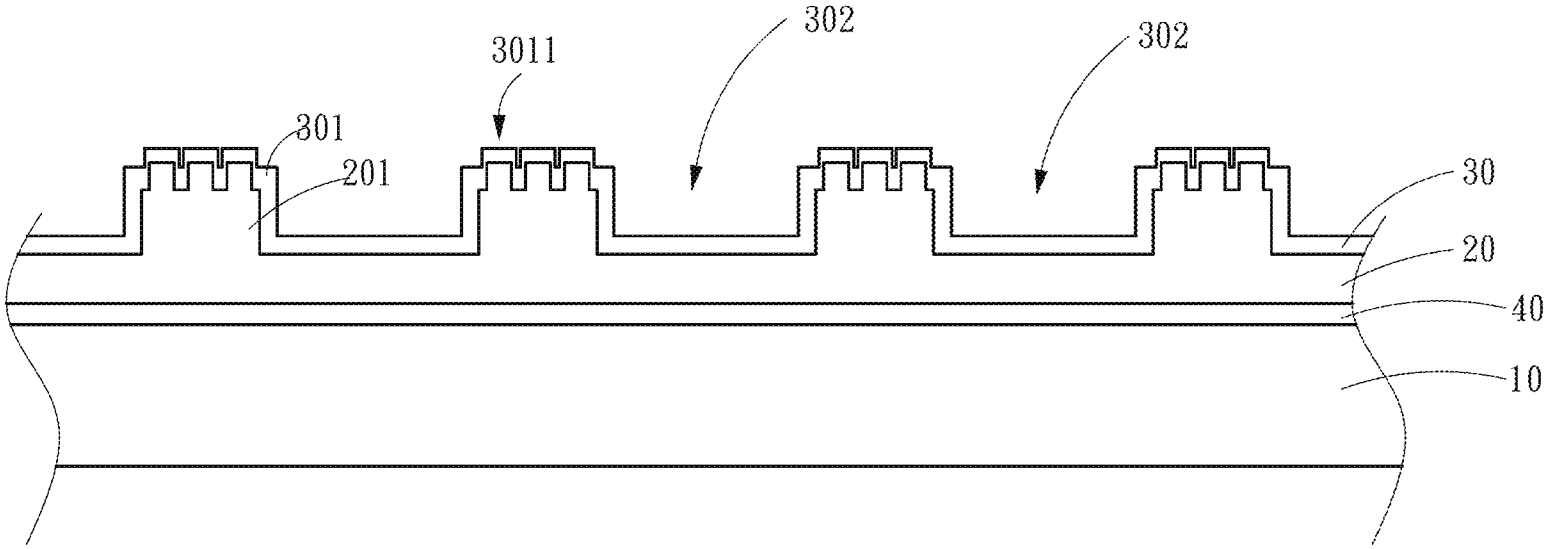
FIG. 2A is a cross-section diagram along A-A' of FIG. 1.
Figure 2B:
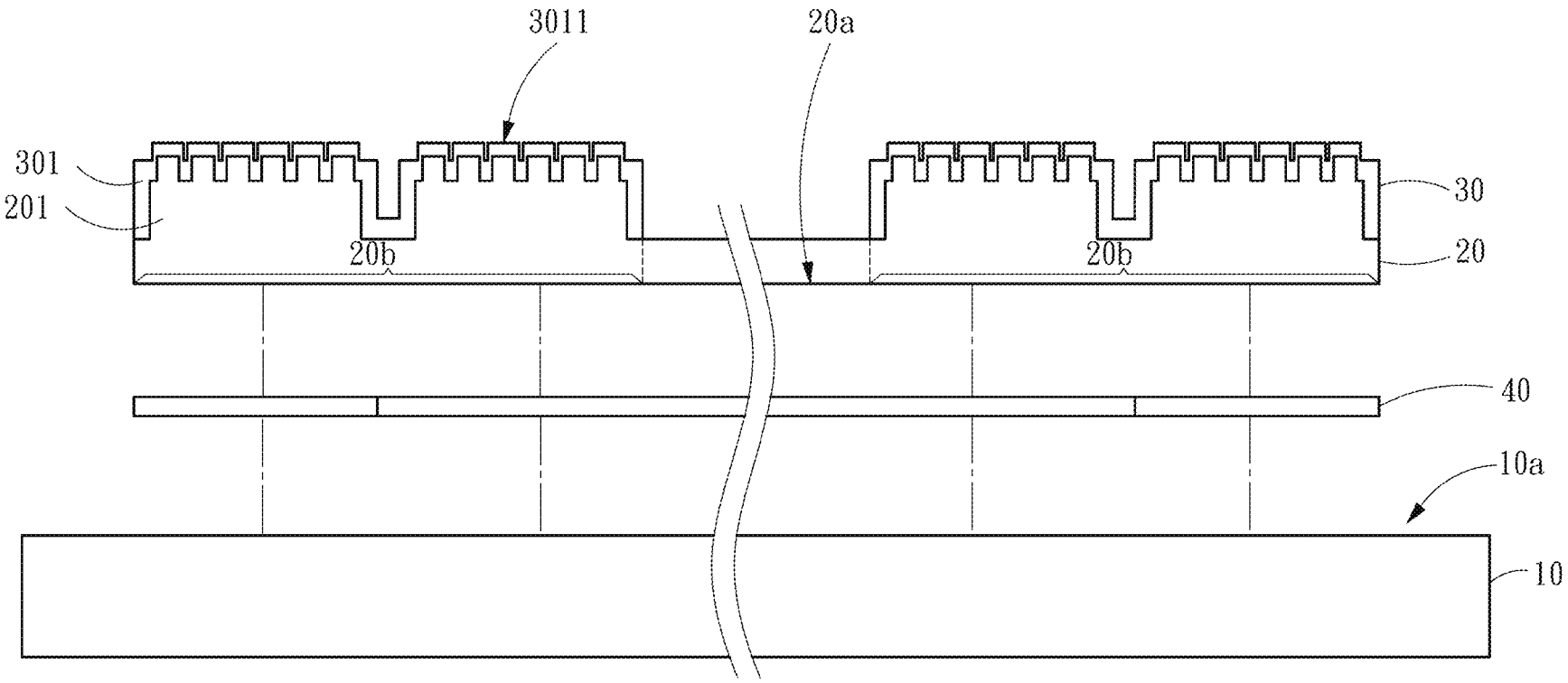
FIG. 2B is a cross-section diagram along B-B' of FIG. 1.

Referring to FIG. 1, together with FIGS. 2A and 2B, there are shown a top view, a cross-section diagram along A-A', and a cross-section diagram along B-B', respectively, of a chemical-mechanical polishing (CMP) abrasive pad conditioner 1 of a first embodiment of the present invention.

The CMP abrasive pad conditioner 1 of the present invention mainly comprises a bottom substrate 10, an intermediate layer 20, and a diamond film 30. In this connection, the intermediate layer 20 is located on the bottom substrate 10, while the intermediate layer 20 is clad in the diamond film 30. In this embodiment, a method for manufacturing the CMP abrasive pad conditioner 1 including:

(S1) providing a bottom substrate 10;

(S2) locating an intermediate layer 20, the intermediate layer 20 including a hollow portion 20*a* and an annular portion 20*b* surrounding the hollow portion 20*a*, the annular portion 20*b* being provided with a plurality of bumps 201 through energy machining (such as, electric discharge machining, laser machining, for example) or die casting, in which, for instance, the electric discharge machining is used cooperatively when a conducting material is used as the intermediate layer 20, while the laser machining is used cooperatively when a non-conducting material is used as the intermediate layer 20 so as to produce the plurality of bumps 201 on the annular portion 20*b*, and additionally, die casting may be further used to obtain the aforementioned configuration directly in the process of formation, in which, for instance, powders are pressed to be an expected shape and then formed by sintering;

(S3) forming a diamond film 30 on the intermediate layer 20, and forming a plurality of abrasive projections 301 by conforming the diamond film 30 to the plurality of bumps 201 of the intermediate layer 20, a top surface 3011 of each of the plurality of abrasive projections 301 being formed with a patterned configuration and provided with a center line average roughness (Ra) between 2 and 20; and (S4) fixing the intermediate layer 20 at one side thereof to the bottom substrate 10.

The configuration of the CMP abrasive pad conditioner 1 will be introduced in more detail hereinafter.

The bottom substrate 10 may be either a planar substrate, or a non-planar substrate provided with a groove accommodating the intermediate layer 20. The material suitable for the bottom substrate 10 of the present invention may be, for example, stainless steel, metallic material, high-molecular material, ceramic material or the combination thereof.

The intermediate layer 20 is located on the bottom substrate 10, and material forming the intermediate layer 20 may be conducting silicon carbide or non-conducting silicon carbide. In this embodiment, the intermediate layer 20 includes a hollow portion 20*a* and an annular portion 20*b* surrounding the hollow portion 20*a*. The annular portion 20*b* is engraved by laser machining to be provided with a plurality of bumps 201. The plurality of bumps 201 are arranged along the annular portion 20*b* to form a projecting ring, and the plurality of bumps 201 may be arranged to form at least one circle of the projecting ring, such as 1 to 20 circles of the projecting rings, preferably 2 to 20 circles of the projecting rings, for example, centered on the hollow portion 20*a* depending on the situation. In this embodiment, two circles of the projecting rings are taken for illustration. In this case, the plurality of bumps 201 of adjacent projecting rings are offset with respect to each other. The shape of each of the plurality of bumps 201 may be, for example, trapezoid, sector, or other shapes designed as required, without special limitation. In this embodiment, the plurality of bumps 201 are formed by engraving through laser machining, and the top surface of each of the plurality of bumps 201 may be also engraved through laser machining to be provided with a patterned configuration. In another embodiment, however, it is also possible to form the plurality of bumps 201 and the patterned configuration through electric discharge machining or die casting, for example, without special limitation in the present invention.

In this embodiment, the diamond film 30 is formed by chemical vapor deposition (CVD). The CVD may be, for example, filament CVD, plasma-enhanced CVT) (PECVD), microwave plasma CVD (MPCVD), or the like. A surface conforming to the plurality of bumps 201 of the intermediate layer 20 so as to cover the intermediate layer 20 is formed with a plurality of abrasive projections 301. In this embodiment, each of the plurality of abrasive projections 301 is presented as an arc with respect to a radial direction of the intermediate layer 20, as drawn in FIG. 1.

The plurality of abrasive projections 301 projected out of the diamond film 30 are also allowed to conform to the plurality of bumps 201, because the diamond film 30 is formed in conformation with the shape of the intermediate layer 20. Thus, a top surface 3011 of each of the plurality of abrasive projections 301 is formed with a patterned configuration corresponding to the plurality of bumps 201. The patterned configuration includes a plurality of solid figures arranged regularly or irregularly. More specifically, the patterned configuration may be a plurality of regularly or irregularly arranged triangular pyramids, quadrangular pyramids, pentagonal pyramids, hexagonal pyramids, heptagonal pyramids, octagonal pyramids, triangular prisms, quadrangular prisms, pentagonal prisms, hexagonal prisms, heptagonal prisms, octagonal prisms, circular cones, circular cylinders, elliptic cones, elliptic circle cylinders or the combination thereof. The top surface 3011 of the abrasive projection 301 is endowed with a center line average roughness (Ra) between 2 and 20 by virtue of the patterned configuration.

In this embodiment, the bottom substrate 10 and the intermediate layer 20 are bound together via a bonding layer 40. Any material with adhesion, such as resin, for example, may be selected for the bonding layer 40. In another embodiment, it is also possible to fix the intermediate layer 20 to the bottom substrate 10 via brazing or mechanical combination.

Figure 4:
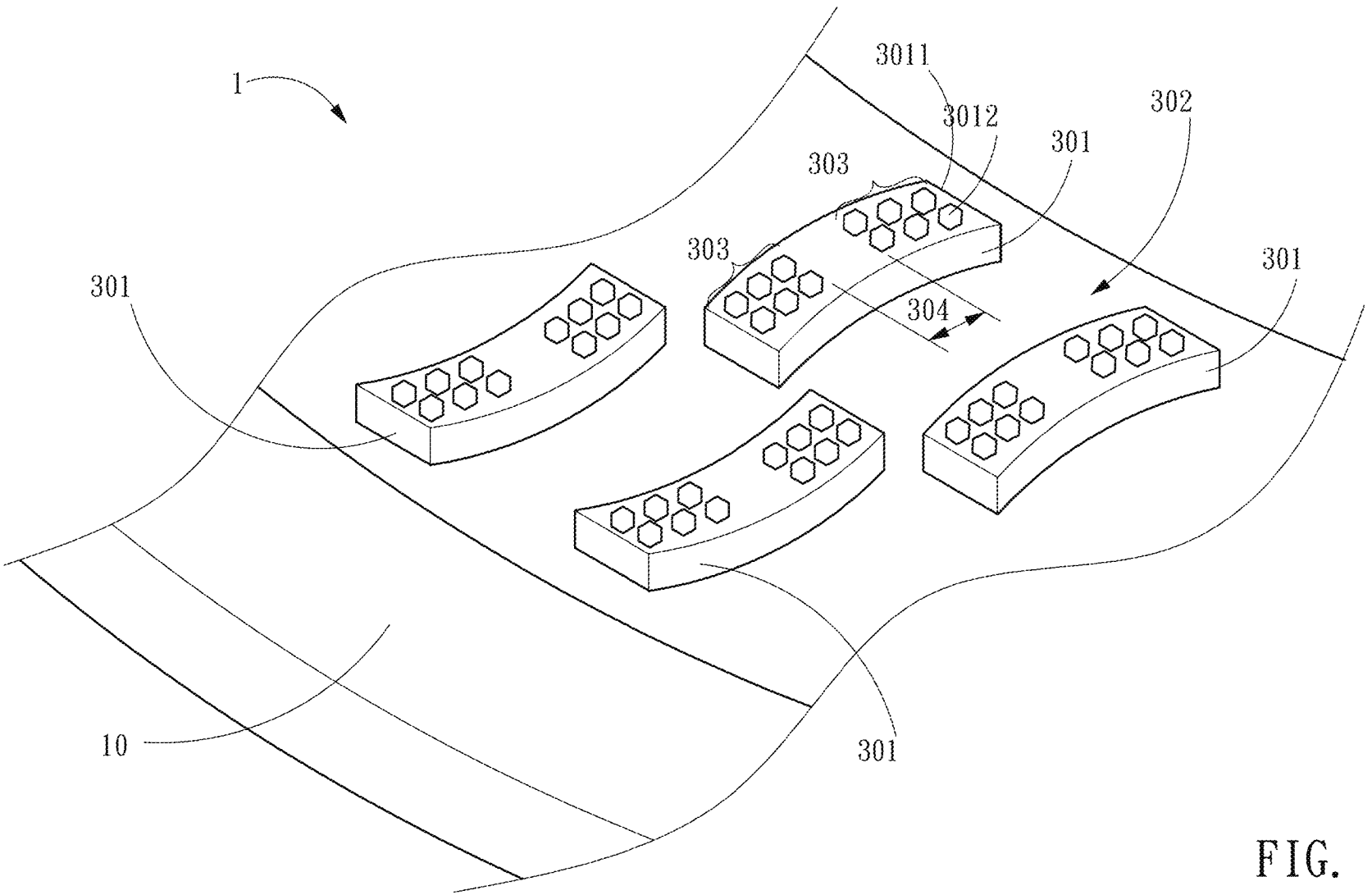
FIG. 4 is a top view overlooking from a working surface (top surface) of FIG. 1.

Referring to FIG. 4, the plurality of abrasive projections 301 and a chip removing channel 302 formed between two abrasive projections 301 may be seen, when the CMP abrasive pad conditioner 1 is overlooked from a working face.

As conforming to the shape of the intermediate layer 20, the top surface 3011 of each of the plurality of abrasive projections 301 of the diamond film 30 is formed thereon with the patterned configuration by virtue of a plurality of solid figures 3012 arranged regularly or irregularly. As described above, the plurality of solid figures 3012 may be selected from the group consisting of triangular pyramid, quadrangular pyramid, pentagonal pyramid, hexagonal pyramid, heptagonal pyramid, octagonal pyramid, triangular prism, quadrangular prism, pentagonal prism, hexagonal prism, heptagonal prism, octagonal prism, circular cone, circular cylinder, elliptic cone, elliptic circle cylinder and the combination thereof.

Figure 3:
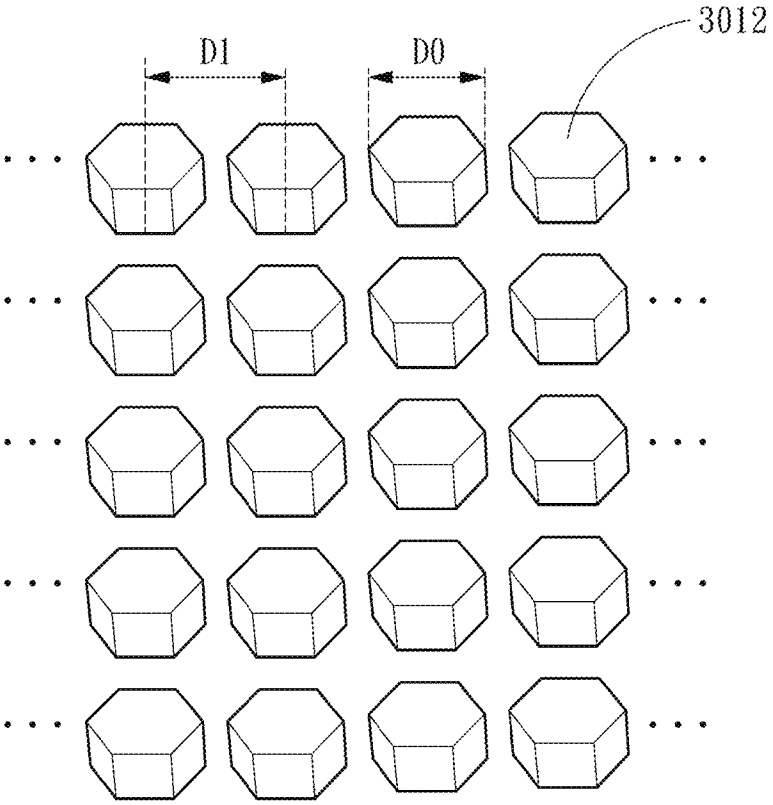
FIG. 3 is a diagram of patterned configuration of a working face (top surface) of FIG. 1.

Referring to FIG. 3 for the purpose of detailed description, a regular hexagonal prism is taken as an example for the plurality of solid FIGS. 3012 of the present invention. There is a first interval D1 between the center point of one of the plurality of solid figure 3012 and the center point of adjacent solid figure 3012.

In this embodiment, the first interval D1 is longer than a width D0 of the solid figure 3012, and thither, the first interval D1 is 0.5 to 8.3 times as long as the width D0 of the solid figure 3012. In this embodiment, the first interval D1 may be in the range of 50 μm to 250 μm, while the width D0 of the solid figure 3012 may be in the range of 30 μm to 100 μm. However, the first interval D1 and the width D0 of the solid figure 3012 may be selected appropriately as required by those skilled in the art without special limitation in the present invention, only if "the first interval D1 is longer than a width D0 of the solid figure 3012, and further, the first interval is 0.5 to 8.3 times as long as the width D0 of the solid figure 3012" described above is satisfied. For instance, in a non-limiting embodiment, the first interval D1 may be 200 μm, while the width D0 may be 80 μm, such that the first interval D1 is 2.5 times as long as the width D0. In another embodiment, the first interval D1 may be 65 μm, while the width D0 may be 30 μm, in such a way that the first interval D1 is 2.17 times as long as the width D0.

In this embodiment, the number of the plurality of solid figures 3012 included on each of the plurality of abrasive projections 301 per square millimeter ($mm^2$) is in the range of 10 to 250, without special limitation in respect of the arrangement of the plurality of solid figures 3012 on the top surface 3011. Referring to FIG. 4, for instance, two solid figure aggregation portions 303 are formed to be arranged on the top surface 3011 of each of the plurality of abrasive projections 301, with at least one flat region 304, in which no abrasive projection 301 is included, remained between the solid figure aggregation portions 303. In another embodiment, however, more than two solid figure aggregation portions 303 may be provided on the top surface 3011. In a further embodiment, nevertheless, the plurality of solid figures 3012 are not aggregated to form the solid figure aggregation portion 303, but evenly formed on the top surface 3011 instead.

Second Embodiment

Figure 5A:
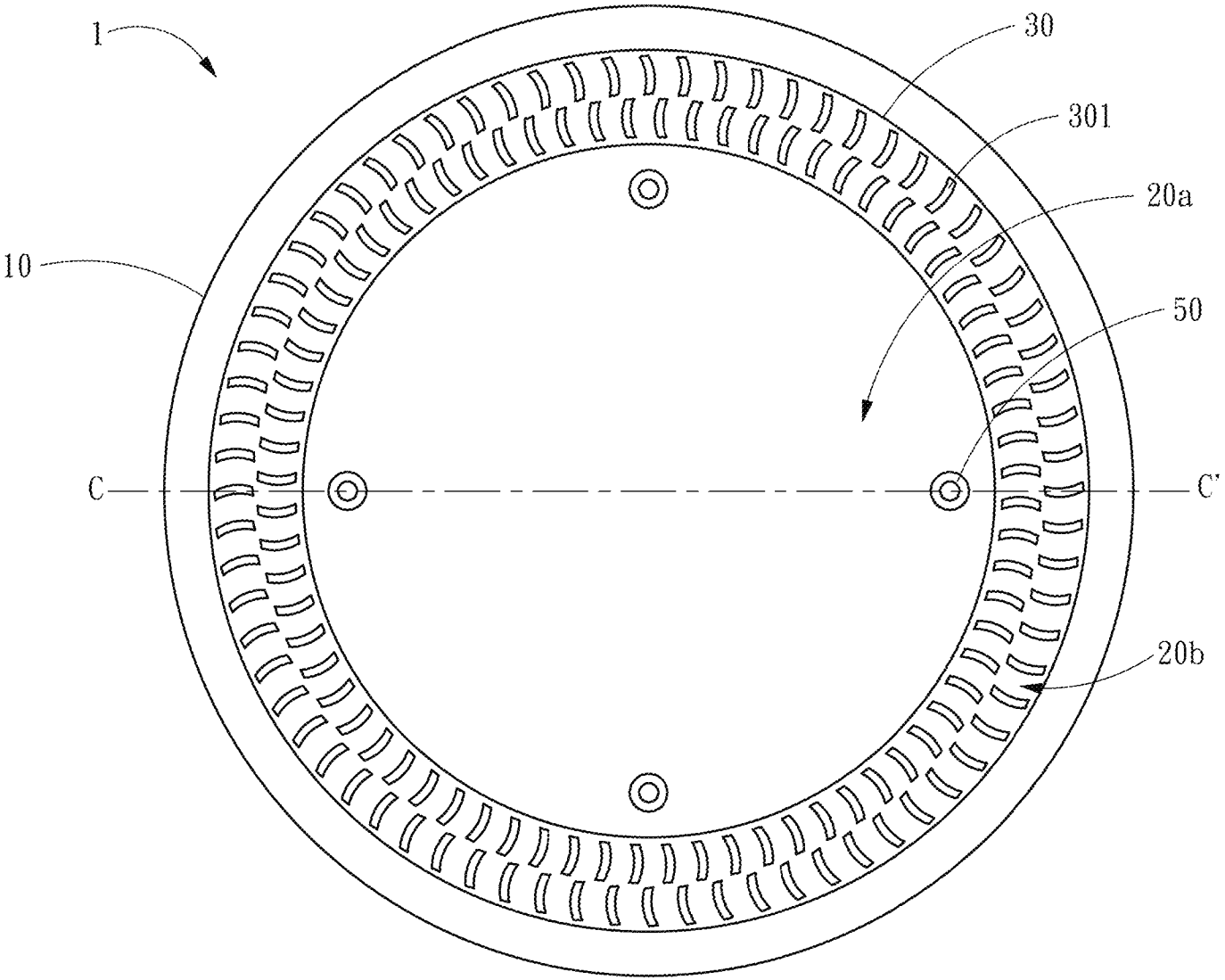
FIG. 5A is a top view of a CMP abrasive pad conditioner of a second embodiment of the present invention.

The CMP abrasive pact conditioner 1 of a second embodiment of the present invention is illustrated in FIG. 5A. In the second embodiment, the configuration of the CMP abrasive pad conditioner 1 is substantially the same as that in the above first embodiment, except for further including a plurality of abrasive units 50.

Figure 5B:
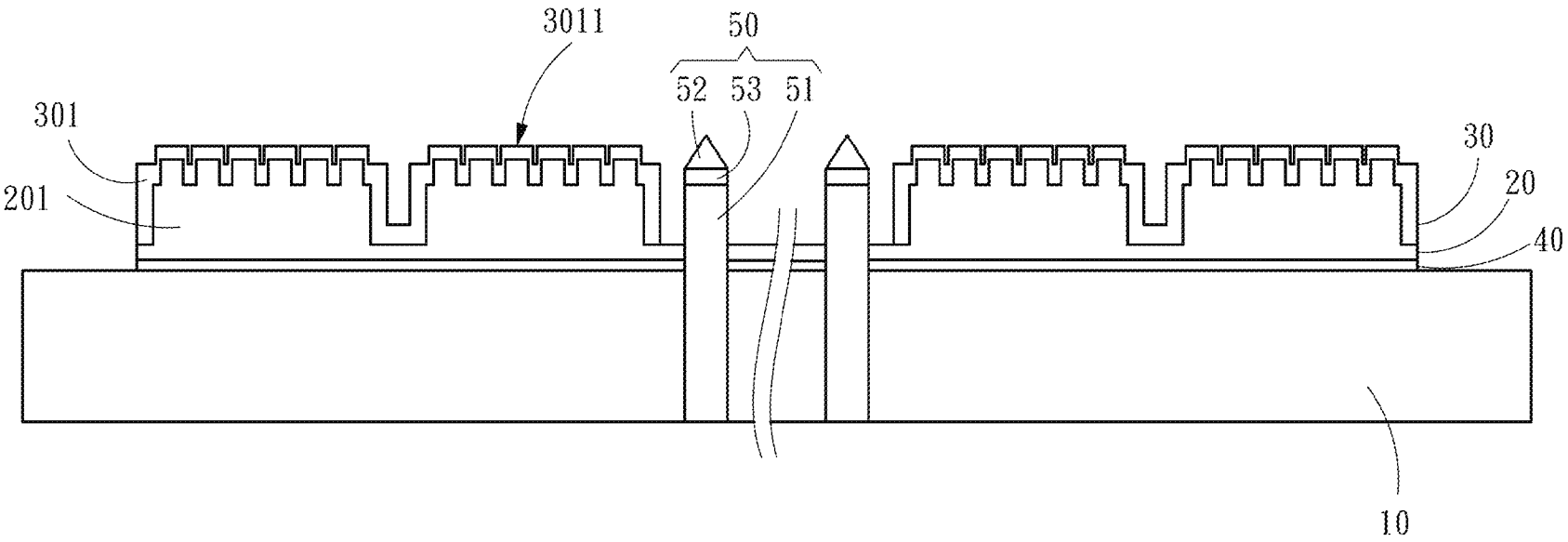
FIG. 5B is a cross-section diagram along C-C' of FIG. 5A.

Proceeding to FIG. 5B, which is a cross-section diagram along C-C' of FIG. 5A, each of the plurality of abrasive units 50 in the CMP abrasive pad conditioner 1 of the second embodiment of the present invention includes a carrying post 51, a polishing particle 52 located on the carrying post 51, and an abrasive bonding layer 53 used for binding the carrying post 51 and the polishing particle 52. In the second embodiment, the plurality of abrasive units 50 are located on the bottom substrate 10 in a place corresponding to the hollow portion 20*a* of the intermediate layer 20.

Figure 6:
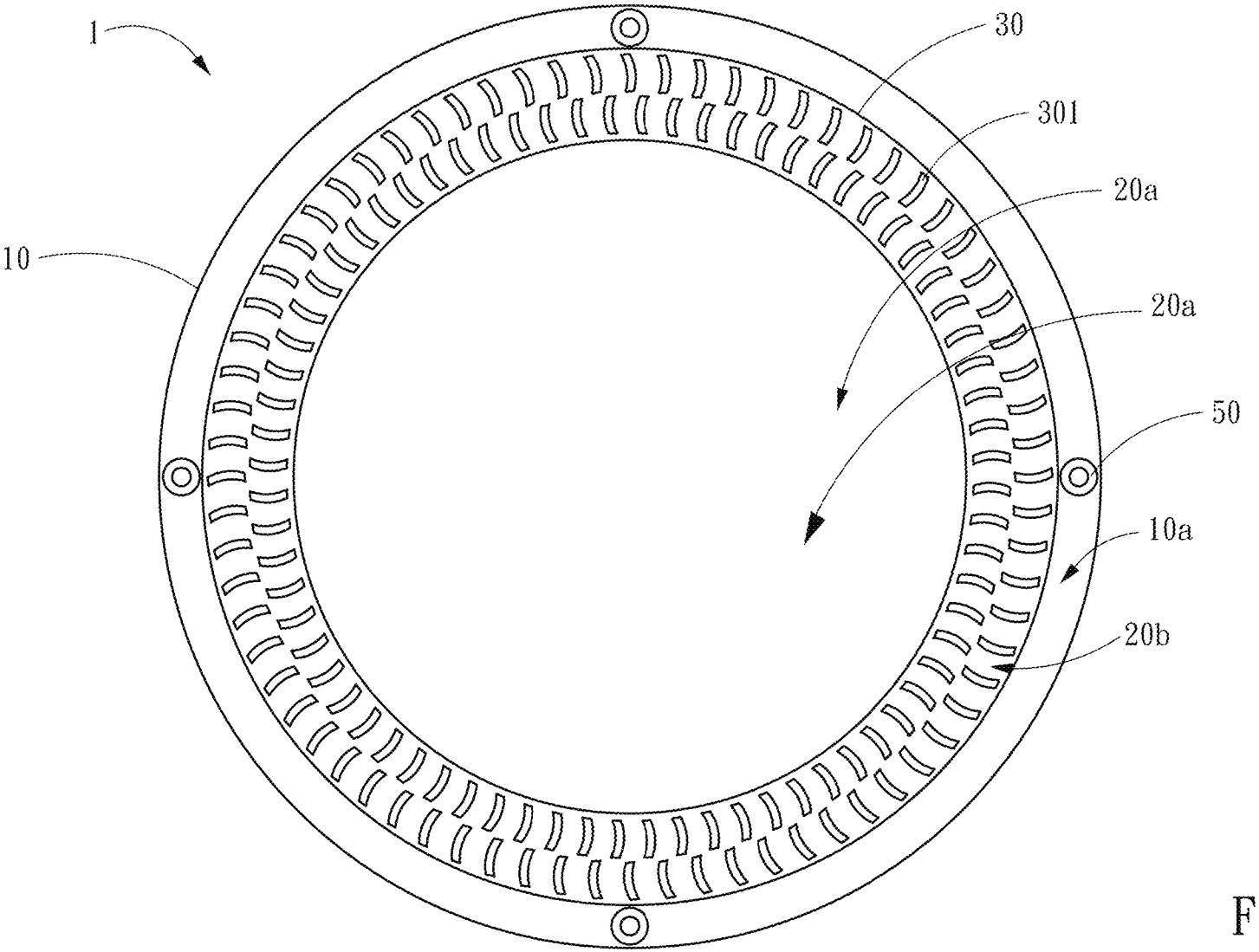
FIG. 6 is a top view of a CMP abrasive pad conditioner in another aspect of the second embodiment of the present invention.

In another embodiment, referring to FIG. 6, there is shown a top view of the CMP abrasive pad conditioner 1 in another aspect of the second embodiment of the present invention. Only difference between the CMP abrasive pad conditioner 1 in this aspect and the CMP abrasive pad conditioner 1 drawn in FIG. 5A is the location of the plurality of abrasive units 50, in which the plurality of abrasive units 50 in the aspect shown in FIG. 6 are located on a peripheral portion 10*a* of the bottom substrate 10 (referring to FIG. 2B together).

FIG. 7A, FIG. 7B, FIG. 8A, FIG. 8B, FIG. 9A, FIG. 9B, FIG. 10A, FIG. 10B, FIG. 11 FIG. 11B, FIG. 12A, FIG. 12B, FIG. 13A, FIG. 13B FIG. 14A and FIG. 14B are photographs, taken by scanning electron microscope (SEM), of the patterned configurations in the present invention in other aspects, including regular or irregular hexagon, regular or irregular pentagon, regular or irregular tetragon and etc., without special limitation in the present invention, only if a top surface 3011 of each of the plurality of abrasive projections 301 is provided with a patterned configuration in such a way that the top surface 3011 is provided with a center line average roughness (Ra) between 2 and 20.

Figure 7B:
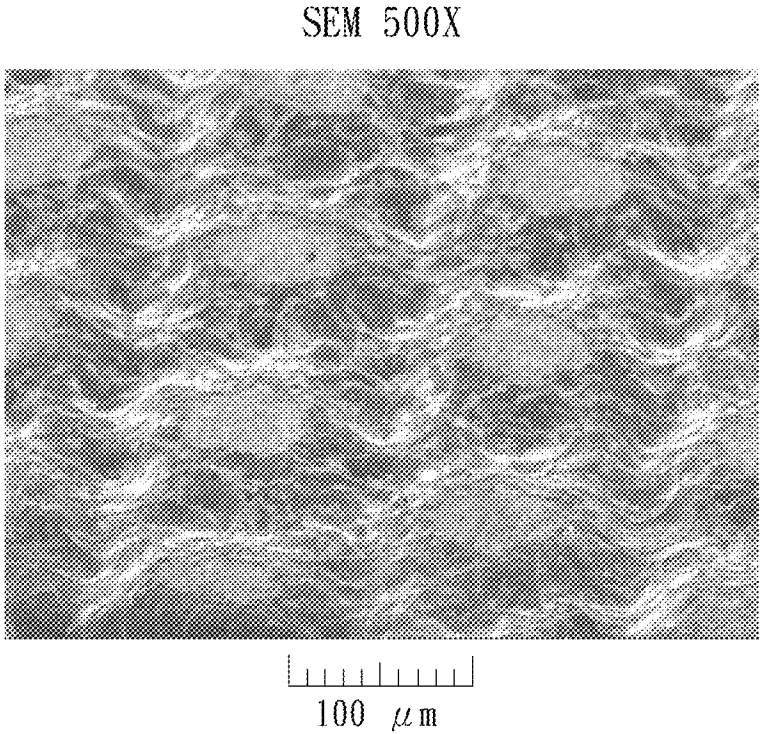
FIGS. 7A to 7B are photographs, taken by scanning electron microscope (SEM), of the patterned configuration in another aspect of the present invention.
Figure 7A:
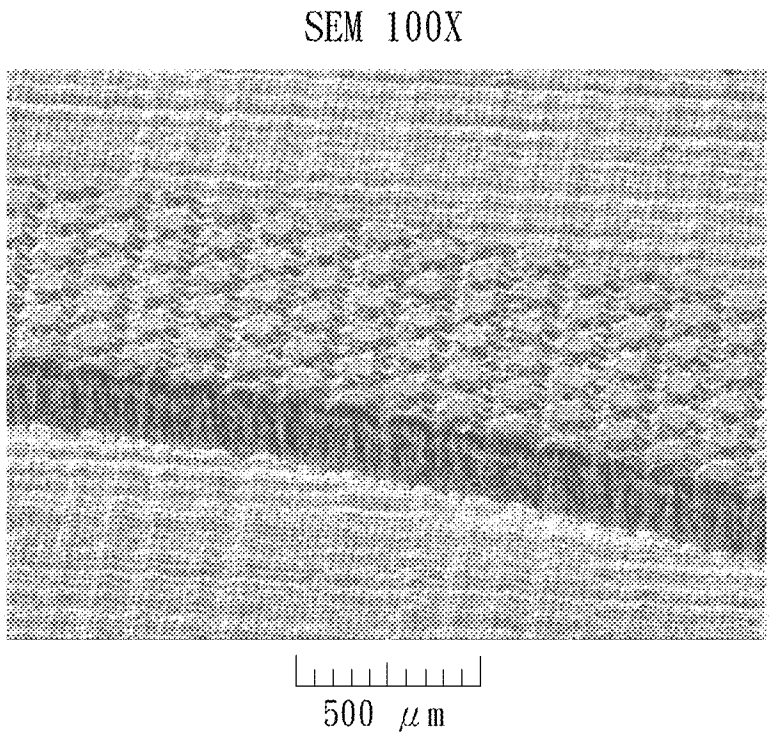

For instance, in the aspect shown in FIG. 7A and FIG. 7B, the top surface includes the patterned configuration comprising a plurality of regularly arranged solid figures, such that the top surface is provided with a center line average roughness (Ra) of 4. In this aspect, moreover, the width of the solid figures is 80 μm, while the distance between center points of two adjacent solid figures (i.e., the first interval) is 200 μm, in such a way that the first interval is 2.5 times as long as the width.

Figure 8B:
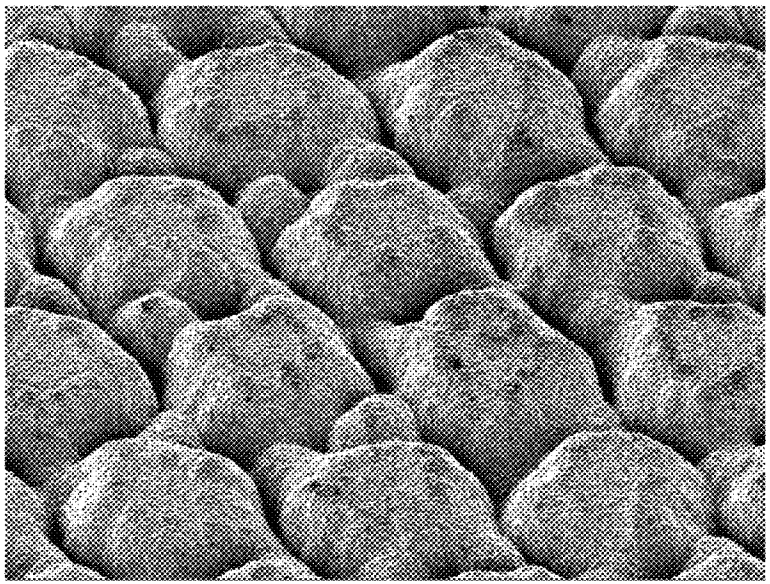
FIGS. 8A to 8B are photographs, taken by scanning electron microscope (SEM), of the patterned configuration in another aspect of the present invention.
Figure 8A:
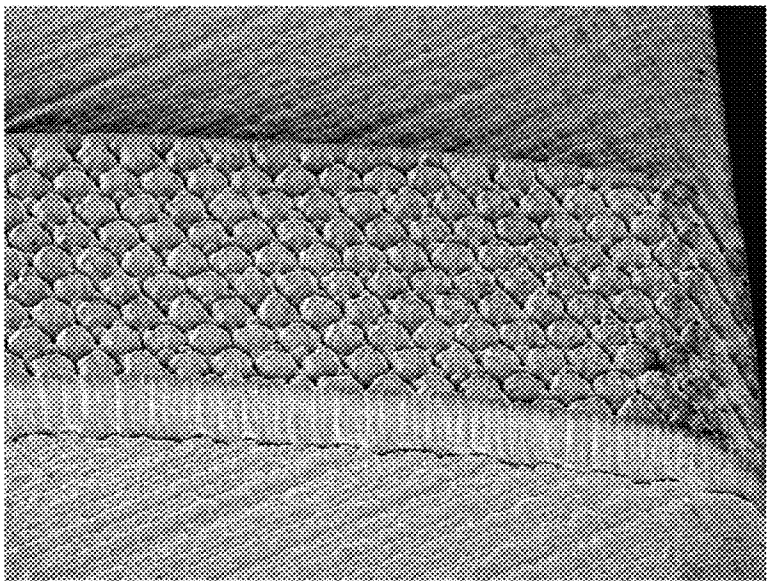

In the aspect shown in FIG. 8A and FIG. 8B, the top surface includes the patterned configuration comprising a plurality of regularly arranged quadrangular prisms, such that the top surface is provided with a center line average roughness (Ra) of 20. In this aspect, moreover, the width of the quadrangular prism is 70 μm, while the distance between center points of two adjacent quadrangular prisms (i.e., the first interval) is 120 μm, in such a way that the first interval is 1.71 times as long as the width.

Figure 9B:
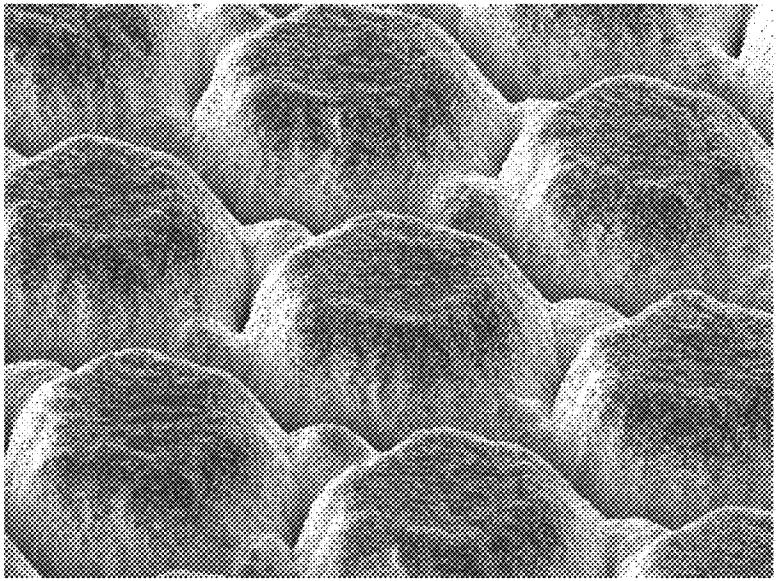
FIGS. 9A to 9B are photographs, taken by scanning electron microscope (SEM), of the patterned configuration in another aspect of the present invention.
Figure 9A:
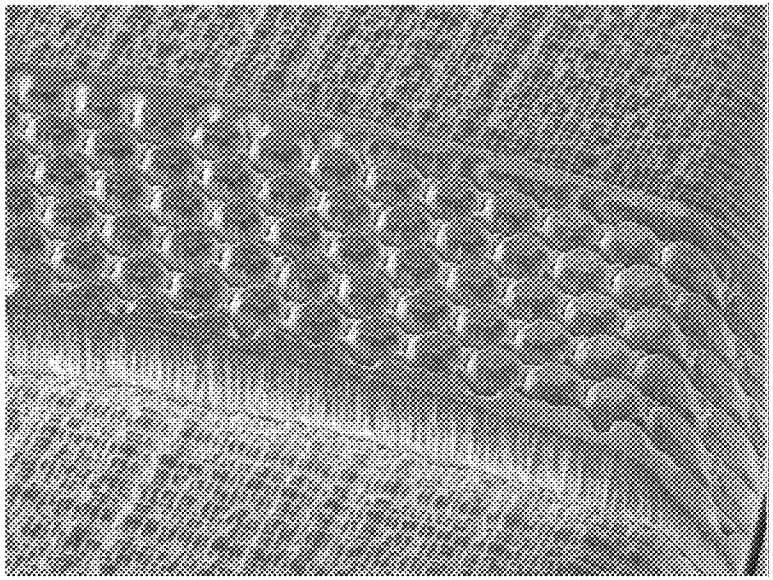

In the aspect shown in FIG. 9A and FIG. 9B, the top surface includes the patterned configuration comprising a plurality of regularly arranged pentagonal prisms, such that the top surface is provided with a center line average roughness (Ra) of 20. In this aspect, moreover, the width of the pentagonal prism is 70 μm, while the distance between center points of two adjacent pentagonal prisms (i.e., the first interval) is 170 μm, in such a way that the first interval is 2.43 times as long as the width.

Figure 10B:
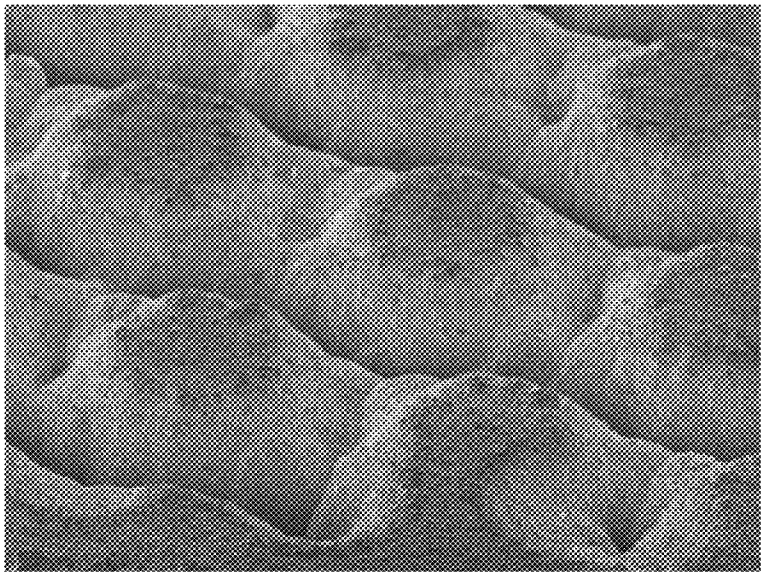
FIGS. 10A to 10B are photographs, taken by scanning electron microscope (SEM), of the patterned configuration in another aspect of the present invention.
Figure 10A:
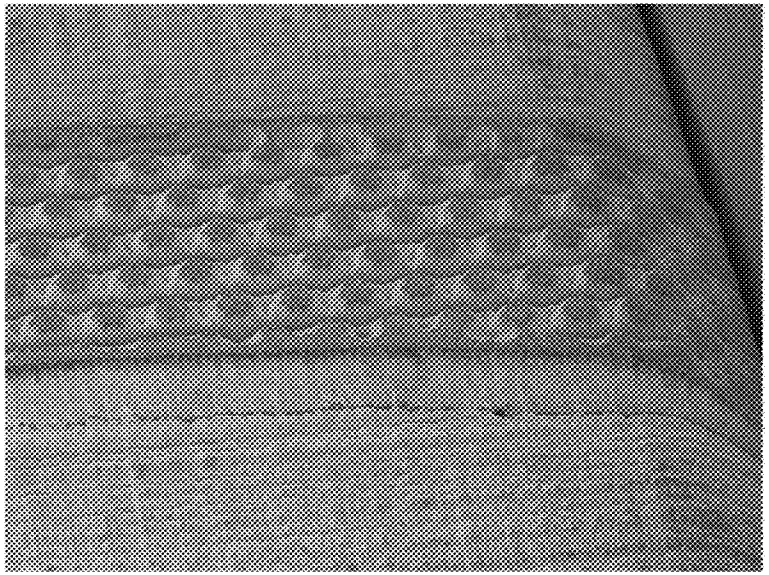

In the aspect shown in FIG. 10A and FIG. 10B, the top surface includes the patterned configuration comprising a plurality of regularly arranged solid figures, such that the top surface is provided with a center line average roughness (Ra) of 15. In this aspect, moreover, the width of the solid figure is 70 μm, while the distance between center points of two adjacent solid figures (i.e., the first interval) is 170 μm, in such a way that the first interval is 2.43 times as long as the width.

Figure 11B:
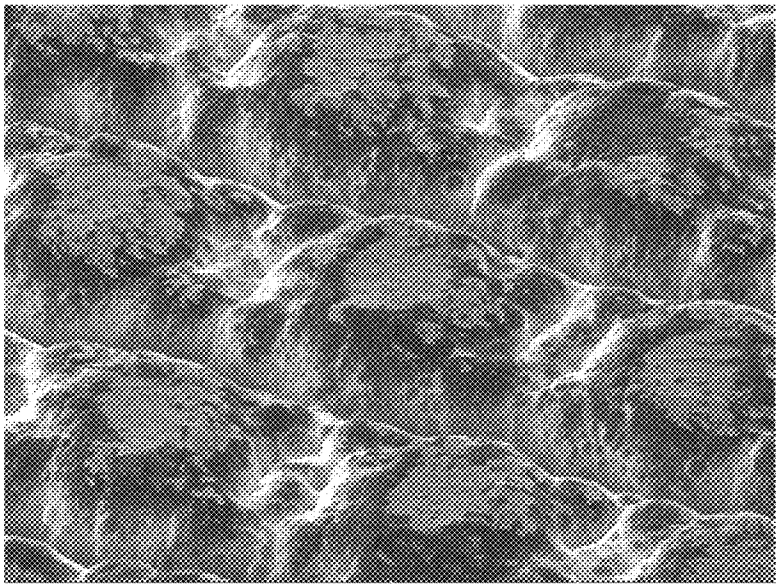
FIGS. 11A to 11B are photographs, taken by scanning electron microscope (SEM), of the patterned configuration in another aspect of the present invention.
Figure 11A:
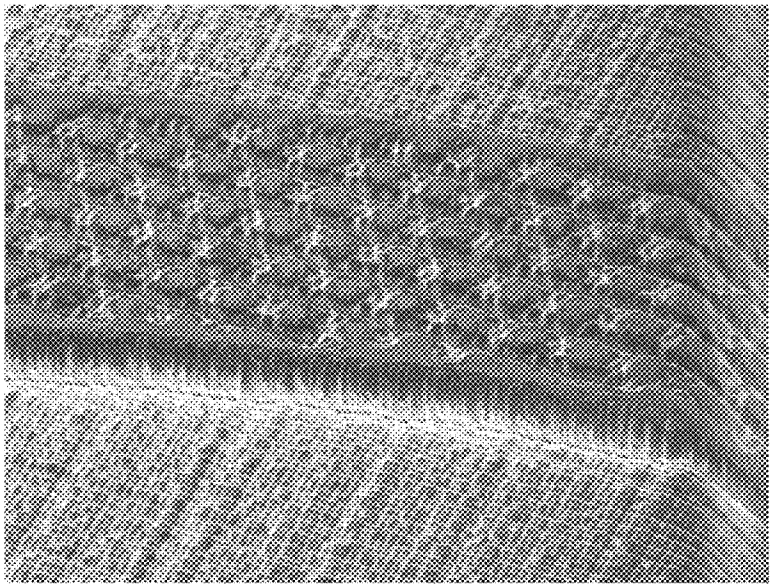

In the aspect shown in FIG. 11A and FIG. 11B, the top surface includes the patterned configuration comprising a plurality of regularly arranged solid figures, such that the top surface is provided with a center line average roughness (Ra) of 12. In this aspect, moreover, the width of the solid figure is 70 μm, while the distance between center points of two adjacent solid figures (i.e., the first interval) is 170 μm, in such a way that the first interval is 2.43 times as long as the width.

Figure 12A:
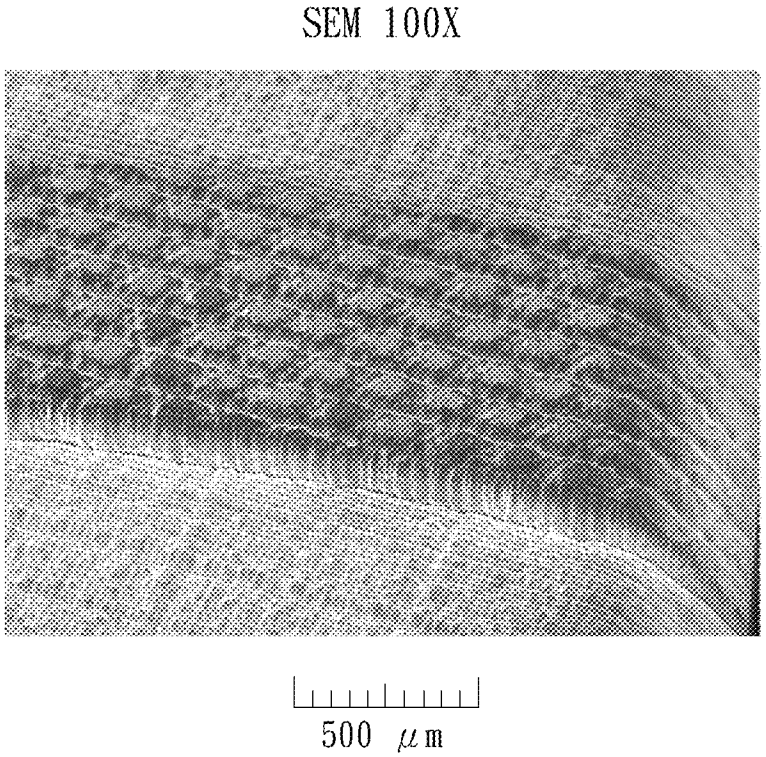
FIGS. 12A to 12B are photographs, taken by scanning electron microscope (SEM), of the patterned configuration in another aspect of the present invention.
Figure 12B:
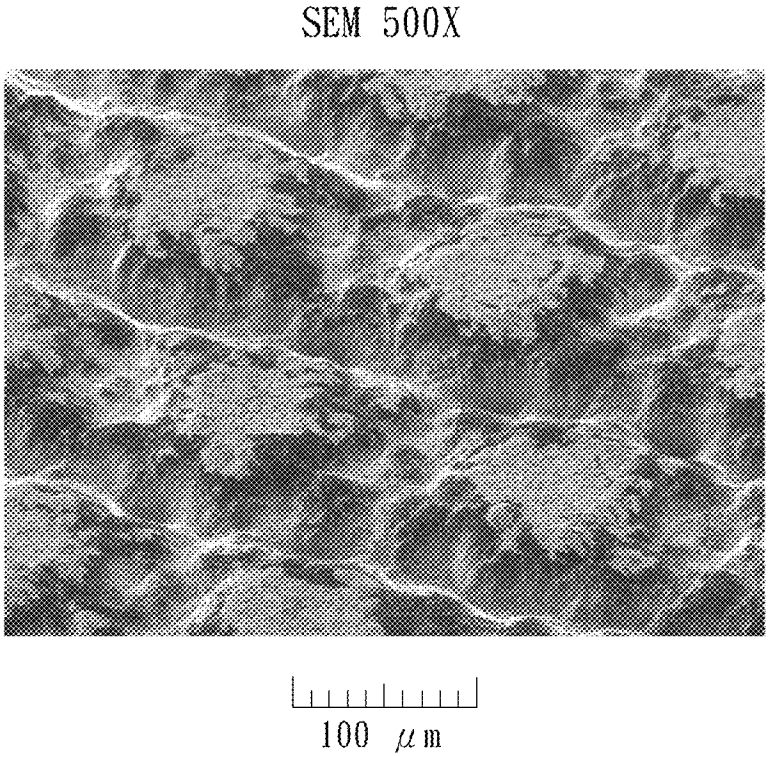

In the aspect shown in FIG. 12A and FIG. 12B the top surface includes the patterned configuration comprising a plurality of regularly arranged solid figures, such that the top surface is provided with a center line average roughness (Ra) of 8. In this aspect, moreover, the width of the solid figure is 70 μm, while the distance between center points of two adjacent solid figures (i.e., the first interval) is 170 μm, in such a way that the first interval is 2.43 times as long as the width.

Figure 13B:
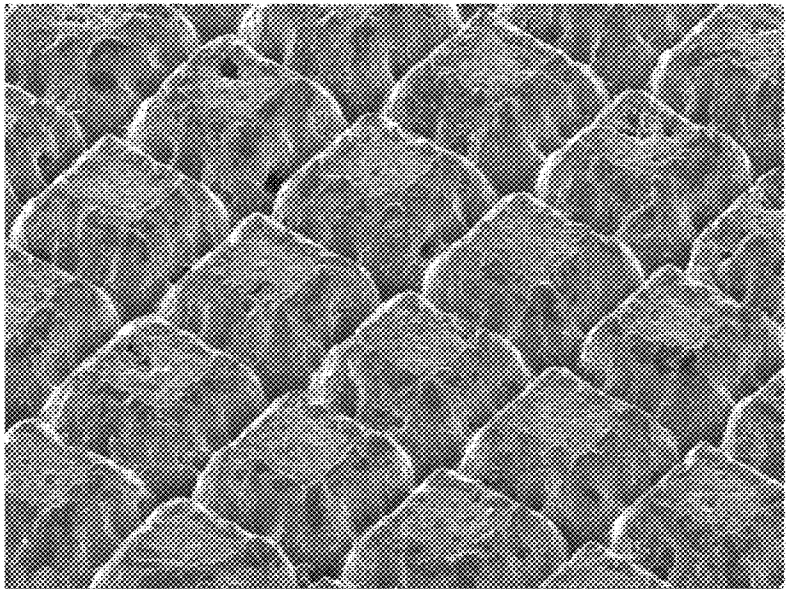
FIGS. 13A to 13B are photographs, taken by scanning electron microscope (SEM), of the patterned configuration in another aspect of the present invention.
Figure 13A:
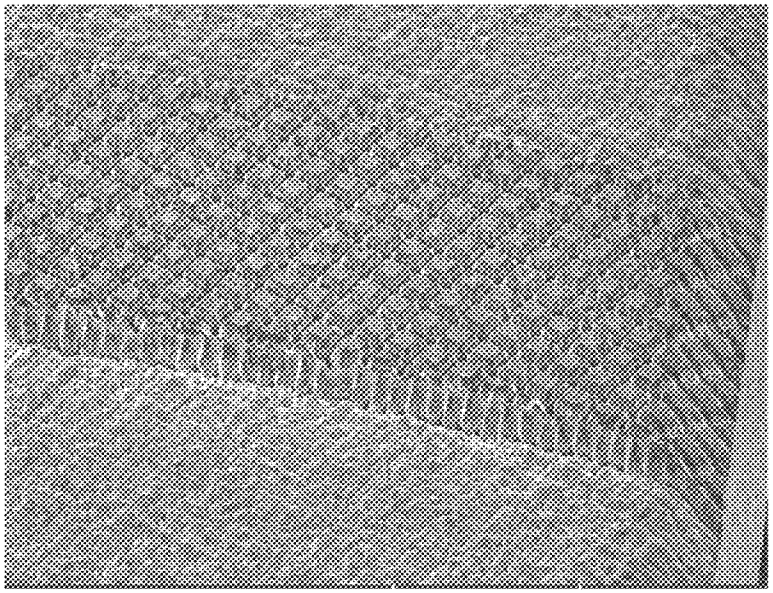

In the aspect shown in FIG. 13A and FIG. 13B, the top surface includes the patterned configuration comprising a plurality of regularly arranged quadrangular prisms, such that the top surface is provided with a center line average roughness (Ra) of 9. In this aspect, moreover, the width of the quadrangular prism is 50 μm, while the distance between center points of two adjacent quadrangular prisms (i.e., the first interval) is 100 μm, in such a way that the first interval is 2 times as long as the width.

Figure 14B:
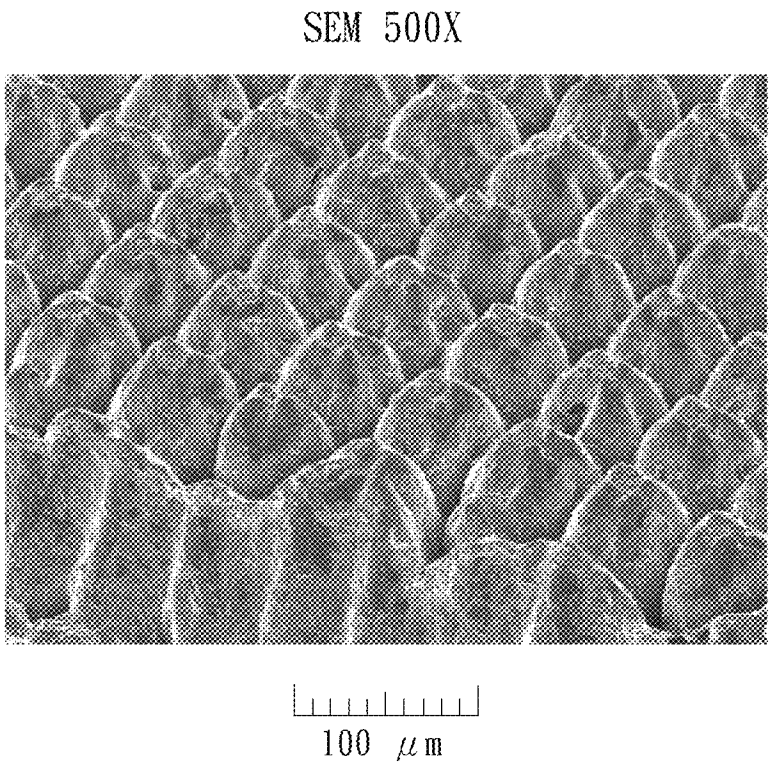
FIGS. 14A to 14B are photographs, taken by scanning electron microscope (SEM), of the patterned configuration in another aspect of the present invention.
Figure 14A:
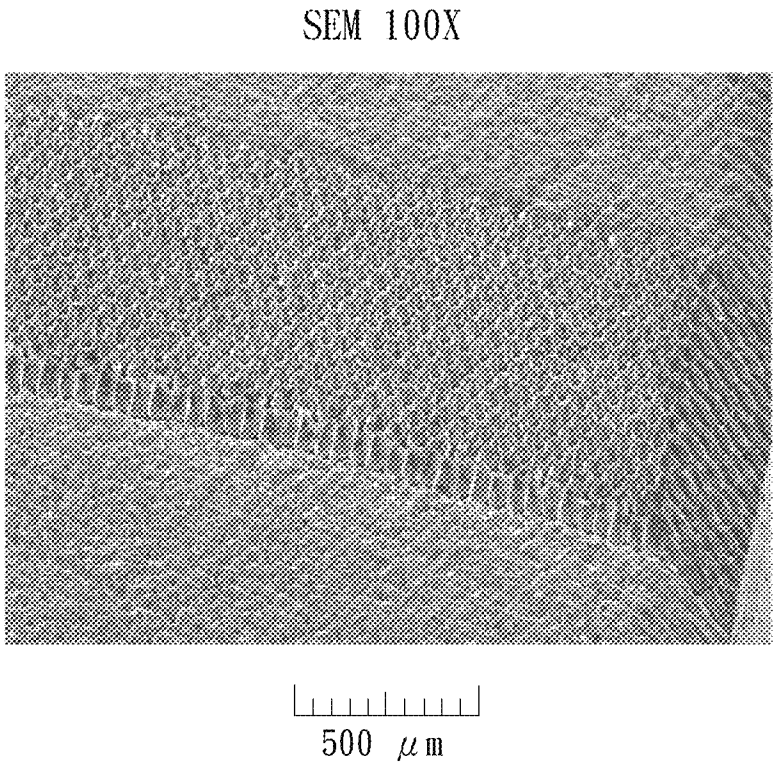

In the aspect shown in FIG. 14A and FIG. 14B, the top surface includes the patterned configuration comprising a plurality of regularly arranged solid figures, such that the top surface is provided with a center line average roughness (Ra) of 9. In this aspect, moreover, the width of the solid figure is 30 μm, while the distance between center points of two adjacent solid figures (i.e., the first interval) is 65 μm, in such a way that the first interval is 2.17 times as long as the width.

To sum up, the CMP abrasive pad conditioner 1 of the present invention is provided on the top surface 3011 thereof with a patterned configuration, so as to increase a center line average roughness (Ra) of the top surface 3011. In comparison with conventional technology, therefore, uniformity of the CMP abrasive pad conditioner 1 of the present invention is enhanced. Furthermore, when the CMP abrasive pad conditioner 1 with good uniformity is used for conditioning, even fragments remained in pores may be also removed successfully. Thereby, removing capability may be enhanced. The above merits are summarized that the service life of the CMP conditioner of the present invention will be extended.

What is claimed is:

1. A CMP abrasive pad conditioner, comprising:

a bottom substrate;

an intermediate layer, located on said bottom substrate, said intermediate layer including a hollow portion and an annular portion surrounding said hollow portion, said annular portion being provided with a plurality of bumps; and a diamond film, located on said intermediate layer, and forming a plurality of abrasive projections corresponding to said plurality of bumps of said intermediate layer;

wherein a top surface of each of said plurality of abrasive projections is formed with a patterned configuration and provided with a center line average roughness between 2 and 20.

2. The CMP abrasive pad conditioner according to claim 1, wherein said patterned configuration includes a plurality of solid figures arranged regularly or irregularly.

3. The CMP abrasive pad conditioner according to claim 2, wherein each of said plurality of solid figures is selected from the group consisting of triangular pyramid, quadrangular pyramid, pentagonal pyramid, hexagonal pyramid, heptagonal pyramid, octagonal pyramid, triangular prism, quadrangular prism, pentagonal prism, hexagonal prism, heptagonal prism, octagonal prism, circular cone, circular cylinder, elliptic cone, elliptic circle cylinder and the combination thereof.

4. The CMP abrasive pad conditioner according to claim 2, wherein there is a first interval between the center point of one of said plurality of solid figures and the center point of the adjacent solid figure, said first interval being longer than a width of said solid figure, and said first interval being 0.5 to 8.3 times as long as said width of said solid figure.

5. The CMP abrasive pad conditioner according to claim 4, wherein said first interval is in a range of 50 μm to 250 μm.

6. The CMP abrasive pad conditioner according to claim 2, wherein each of said plurality of solid figures is provided with a width between 30 μm and 100 μm.

7. The CMP abrasive pad conditioner according to claim 2, wherein a number of said plurality of solid figures included on each of said plurality of abrasive projections per square millimeter is in a range of 10 to 250.

8. The CMP abrasive pad conditioner according to claim 2, wherein said plurality of solid figures are arranged to form a plurality of solid figure aggregation portions on each of said plurality of abrasive projections.

9. The CMP abrasive pad conditioner according to claim 8, wherein at least one flat region is provided between one of said plurality of solid figure aggregation portions and one adjacent solid figure aggregation portion, without said plurality of abrasive projections being included in said flat region.

10. The CMP abrasive pad conditioner according to claim 1, wherein said intermediate layer is made of conducting silicon carbide or non-conducting silicon carbide.

11. The CMP abrasive pad conditioner according to claim 1, wherein each of said plurality of abrasive projections is presented as an arc with respect to a radial direction of said intermediate layer.

12. The CMP abrasive pad conditioner according to claim 1, wherein said plurality of bumps are arranged on said annular portion to form projecting rings, and said plurality of bumps of adjacent projecting rings are offset with respect to each other.

13. The CMP abrasive pad conditioner according to claim 1, wherein said plurality of bumps of said annular portion are formed through energy machining or die casting.

14. A method for manufacturing CMP abrasive pad conditioner, comprising:

providing a bottom substrate;

locating an intermediate layer, said intermediate layer including a hollow portion and an annular portion surrounding said hollow portion, said annular portion being formed thereon with a plurality of bumps;

forming a diamond film on said intermediate layer, and forming a plurality of abrasive projections by conforming said diamond film to said plurality of bumps of said intermediate layer, a top surface of each of said plurality of abrasive projections being formed with a patterned configuration and provided with a center line average roughness between 2 and 20; and fixing said intermediate layer at one side thereof to said bottom substrate.

15. The manufacturing method according to claim 14, wherein said intermediate layer is fixed to said bottom substrate via a bonding layer.

16. The manufacturing method according to claim 14, wherein said plurality of bumps of said annular portion are formed through energy machining or die casting.

* * * * *